United States Patent [19]

Hall

[11] 4,265,548

[45] May 5, 1981

[54] HOME ROTARY PAINT MIXER

[76] Inventor: Clarence J. Hall, 1104 Holiday La., Kewanee, Ill. 61443

[21] Appl. No.: 72,974

[22] Filed: Sep. 6, 1979

[51] Int. Cl.[3] ..... B01F 3/10; B01F 9/02

[52] U.S. Cl. ..... 366/208; 366/605; 366/213

[58] Field of Search ..... 366/208, 209, 213, 220, 366/605

[56] References Cited

U.S. PATENT DOCUMENTS

| | | | |
|---|---|---|---|
| 2,006,451 | 7/1935 | Glidden | 366/213 |
| 2,610,041 | 9/1952 | Stahl | 366/605 X |
| 2,868,519 | 1/1959 | Tocci | 366/209 |
| 3,090,604 | 5/1963 | Wheeler | 366/213 |

*Primary Examiner*—Philip R. Coe

*Attorney, Agent, or Firm*—Glenn H. Antrim

[57] ABSTRACT

A cage of spaced rods is proportioned to fit a gallon can of paint. A stand of formed rod supports the cage and an electrical, gear-reduction motor. The motor is connected to the cage, and a can of paint to be mixed within the cage is rotated about its axis by operation of the motor. A rotational speed of 25 to 30 revolutions per minute is fast enough to mix paint in a moderate amount of time with this inexpensive mixer.

2 Claims, 2 Drawing Figures

HOME ROTARY PAINT MIXER

BACKGROUND OF THE INVENTION

This invention relates to rotary mixers for mixing liquids and particularly to rotary mixers suitable for mixing paints at home.

Power mixers used commercially for mixing liquids are powerful and rugged to provide strong mixing action. Usually, commercial mixers are made to mix large quantities either by reciprocating containers or by rotating containers on axes that are inclined to the axes of the containers. Since machines that provide rapid mixing action are too expensive for home owners to buy to save moderate amounts of time, persons painting at home usually use narrow paddles to mix paints manually. However, inexpensive paint mixers would be worthwhile at home to mix the paints while other preparations are being made for painting or while the last portions of mixed paints are being used.

SUMMARY OF THE INVENTION

A cylindrical cage of spaced rods is proportioned to hold a gallon can of paint that is to be mixed. The cage is divided along its axis into two similar parts that are connected together by hinges and diametrically opposite latches. A gallon can of paint is inserted after opening one of the parts like a door, and then the can of paint can be mixed gently within a moderate amount of time by rotating the cage and the can of paint on their axis.

The cage has a pair of axles extending from respective ends thereof in line with the axis of the cage. A frame for supporting the cage is formed from rod, and the cage is supported with its axis inclined between the ends of the frame. One of the axis is rotatively supported at one level by one end of the frame, and the other axle is connected at a different level to a shaft of a motor, the motor being secured to the frame. The motor is operable to rotate the can of paint to be mixed while the axis of the can is inclined. By placing the bottom of a can in the lower end of the cage, any amount of paint within the can is readily mixed, and when the amount is small, the paint remains at the bottom of the can.

DESCRIPTION OF THE PREFERRED EMBODIMENT

Figure 1:
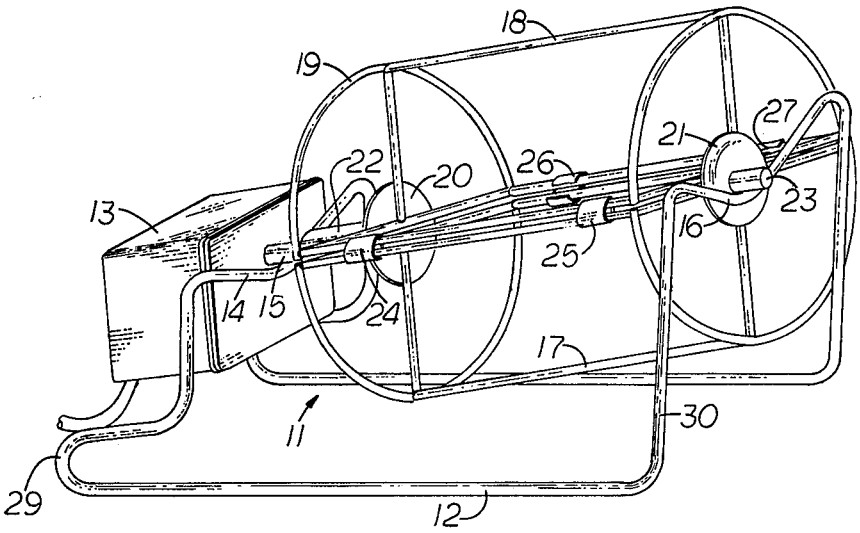
FIG. 1 is an oblique side view of the paint mixer of this invention.

With reference to FIG. 1, a cage 11 for retaining a gallon can of paint is supported on a frame 12 of continuous rod. The axis of the cage 11 is inclined, and an electric gear-reduction motor 13 connected to the frame 12 is operable to rotate the cage 11 on its axis. The motor 13 is supported outside the frame 12 by being secured to the central, upper portion of the end 14 of the frame 12. The upper portion of the end 14 extends in opposite directions for a distance past the motor 13, and then at each side the frame is turned downwardly to a U-bend 29 that extends backwardly and longitudinally beside the motor 13 to provide stability. At each side, a portion for a base of the frame 12 extends forwardly and horizontally from the U-bend 29 for a distance somewhat longer than the length of the cage 11 to a point where each side is turned upwardly to form respective vertical end portions 30, and the upper portions of the vertical end portions are joined by a broad V-shaped portion 16. The lowest point or vertex of the portion 16 is at a level substantially higher than the position of the shaft 15 of the motor 13.

The cage 11 has two main parts 17 and 18, each of which outline a half cylinder formed by separating the cage 11 longitudinally through its axis. Each of the parts 17 and 18 have at each end a semicircular piece of rod 19, and the ends of both of the semicircular pieces 19 are joined by four straight pieces of rod to form a rectangle on the diametrical plane of the respective main part 17 or 18. Each of the parts 17 and 18 also have a piece of rod connected longitudinally between midpoints of the respective semicircular pieces 19, and a short piece of rod is connected from the midpoint of each of the semicircular pieces 19 in a radial direction toward the axis of the cage 11 to respective midpoints of the end pieces of the rectangle in the diametrical plane.

At one end of the half-cylindrical part 17, the inner end of each of the three radial pieces of rod are welded to the inside face of a disk 20, and likewise at the other end of the part 17, the corresponding radial pieces of rod are welded to a disk 21. An axle 22 extends in an axial direction outwardly from the outer face of the disk 20, and likewise an axle 23 extends in an axial direction outwardly from the disk 21. The axle 22 is coupled to the shaft 15 of the motor 13, and the axle 23 is rotatively coupled to the end portion 16. A separate bearing is not required for coupling the axle 23 for it simply may be positioned in the vertex of the end 16. The radial pieces at the ends of the part 18 are not connected to the disks 20 and 21, but are a sliding fit within the inside faces of the disks so that the pieces of rod forming the rectangles for the different half-cylinders 17 and 18 may be positioned side by side to form the complete closed cage 11.

The pieces forming the rectangles are held together by a pair of spaced hinges 24 and 25 between adjacent longitudinal pieces of rod and by spaced latches 26 and 27 between opposite longitudinal pieces of rod. The hinges 24 and 25 may be simply loops, the loops being welded to the longitudinal pieces or rod of the part 17 and the adjacent rod being loose enough within the loops to permit rotation of the part 18. The latches 26 and 27 may be pieces of spring material securely fastened to the part 17, the pieces having hooked portions for engaging the adjacent rod of the part 18.

Figure 2:
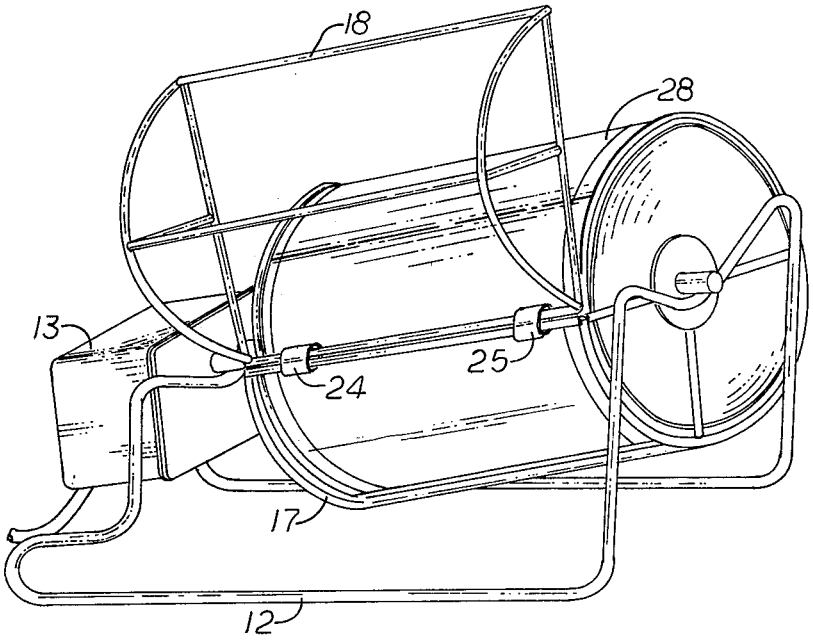
FIG. 2 is an oblique side view with the cage open to receive a gallon can of paint.

When a can of paint is to be mixed, the latches 26 and 27 are unlatched and the part 18 as shown in FIG. 2 is rotated about the hinges 24 and 25. A can of paint 28 is the positioned in the half-cylindrical part 17 of the cage 11, and the similar part 18 is closed about the can and latched. Preferably when a can is partly empty, the bottom of the can will be positioned at the lower level so that the paint will be mixed in the lower end of the can. In order to mix the paint in a reasonable amount of time while a person is making preparations for painting, the motor 13 needs to rotate the can at the rate of only 25 to 30 revolutions per minute.

I claim:

1. A rotary paint mixer comprising:

a cylindrical cage proportioned to fit quite closely about a cylindrical can that contains paint to be mixed, first and second axles connected respectively to opposite ends of said cage, said axles extending outwardly in line with the axis of said cage, a frame supporting said cage, an electric gear-reduction motor with an output shaft connected to an end of said frame, means for connecting said first axle to said shaft, said motor being operable to rotate said cage within said frame, said second axle of said cage being rotatively supported by the other end of said frame, one of said axles being supported at a substantially higher level than the other of said axles, said cage having a first part to which said axles are connected and a second part hinged to said first part, each of said parts being half of a cylinder with a plane side through the axis of the cylinder, each of said parts being fabricated from a plurality of spaced rods, said plane side of each of said parts being a rectangular frame having first and second side portions, said first side portions being positioned side by side, hinge means connecting said first side portions, said second part of said cage being rotatable about said hinge means to an open position of said cage to permit insertion of a can of paint therein, and latching means connecting said second side portions of said plane sides while said second part of said cage is rotated to a closed position where said second side portions are adjacent and said can is retained within said cage.

2. A rotary paint mixer as claimed in claim 1 wherein said frame is fabricated from rod formed into a continuous piece, said frame having a pair of parallel longitudinal spaced side portions as a base and a pair of opposite end portions directly upwardly therefrom of different heights for supporting said motor and said second axle respectively, a U-shaped portion beside said motor between each of said side portions of said frame and said end portion that supports said motor, and the upper end of said end portion that supports said second axle being a transverse V-shape having a vertex for receiving said second axle.

* * * * *